US007602360B2

(12) United States Patent
Park

(10) Patent No.: US 7,602,360 B2
(45) Date of Patent: Oct. 13, 2009

(54) LIQUID CRYSTAL DISPLAY AND A DRIVING METHOD THEREOF

(75) Inventor: Jun-Ho Park, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 707 days.

(21) Appl. No.: 10/938,083

(22) Filed: Sep. 10, 2004

(65) Prior Publication Data

US 2005/0264504 A1 Dec. 1, 2005

(30) Foreign Application Priority Data

May 25, 2004 (KR) ..... 10-2004-0037275

(51) Int. Cl.
*G09G 3/36* (2006.01)

(52) U.S. Cl. ..... 345/89; 345/55; 345/203; 345/690

(58) Field of Classification Search ..... 345/88, 345/55, 203, 690, 89
See application file for complete search history.

(56) References Cited

U.S. PATENT DOCUMENTS

| | | | |
|---|---|---|---|
| 6,519,013 | B1 | 2/2003 | Nagai et al. |
| 6,567,063 | B1 | 5/2003 | Okita |
| 2002/0163490 | A1 | 11/2002 | Nose |
| 2004/0056831 | A1 * | 3/2004 | Takatori et al. ..... 345/88 |
| 2004/0104881 | A1 * | 6/2004 | Furuya ..... 345/98 |

FOREIGN PATENT DOCUMENTS

| | | |
|---|---|---|
| CN | 1232243 | 10/1999 |
| CN | 1310434 | 8/2001 |
| CN | 1409164 | 4/2003 |
| EP | 1 253 577 A1 | 10/2002 |
| JP | 11-038386 | 2/1999 |
| JP | 1 253 577 A1 * | 10/2002 |
| JP | 2003-107425 | 4/2003 |
| JP | 2004-61670 | 2/2004 |

OTHER PUBLICATIONS

European Search Report dated Jul. 17, 2007, for EP 04077575.1, in the name of Samsung SDI Co., Ltd.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A method for driving a liquid crystal display is provided. The display includes a liquid crystal formed between a first substrate and a second substrate, a first electrode arranged at the first substrate, a second electrode arranged at the second substrate, and red, green, and blue lights sequentially transmitting on one pixel of the display. The driving method includes applying a gray voltage based on gray data between the first electrode and the second electrode during a first part in a first period and applying a reset voltage to reset a liquid crystal between the first electrode and the second electrode to a desired state during a second part in the first period.

4 Claims, 8 Drawing Sheets

LIQUID CRYSTAL DISPLAY AND A DRIVING METHOD THEREOF

CROSS REFERENCE TO RELATED APPLICATION

This application claims priority to and the benefit of Korea Patent Application No. 10-2004-0037275 filed on May 25, 2004 in the Korean Intellectual Property Office, the entire content of which is incorporated herein by reference.

BACKGROUND OF THE INVENTION (a) Field of the Invention

The present invention relates to a liquid crystal display and a driving method thereof. More specifically, the present invention relates to a field sequential driving type liquid crystal display (FS-LCD), and a driving method thereof.

(b) Description of the Related Art

As personal computers and televisions, etc. become more lightweight and thin, their display devices should also be lightweight and thin. Accordingly, flat panel displays such as liquid crystal displays (LCDs), which are both light weight and thin, have recently been developed for these computers and televisions in place of cathode ray tubes (CRTs).

An LCD is a display device that obtains a desired video signal by applying and controlling the strength of electric fields to liquid crystal materials of anisotropic dielectric constants injected between two substrates so as to control an amount of light transmitted through the substrates from an external light source (e.g., backlight).

The LCD is representative of an example of portable flat panel displays, and, among LCDs, a TFT-LCD using thin film transistors (TFTs) as switching elements is mainly used.

Each pixel in a TFT-LCD can be modeled with capacitors having liquid crystal as a dielectric substance, such as a liquid crystal capacitor. An equivalent circuit of each pixel in such an LCD is shown in FIG. 1.

As shown in FIG. 1, each pixel of the liquid crystal display includes a TFT 10 having a source electrode and a gate electrode that are respectively connected to a data line (Dm) and a scanning line (Sn). The pixel also includes a liquid crystal capacitor Cl connected from the drain electrode of the TFT 10 to a common electrode where voltage Vcom is applied and a storage capacitor Cst connected to the drain electrode of the TFT 10.

In FIG. 1, when a scanning signal is applied to a scanning line (Sn) and the TFT 10 is turned on, data voltages (Vd) supplied to a data line are applied to each pixel electrode (not shown) through the TFT 10. Then, an electric field corresponding to a difference between pixel voltage Vp applied to the pixel electrodes and common voltage Vcom is applied to a liquid crystal (which is equivalently shown as a liquid crystal capacitor in FIG. 1). Light transmits with transmittivity corresponding to the strength of the electric field. In the pixel of FIG. 1, a pixel voltage Vp needs to be maintained during one (1) frame or one (1) field, and a storage capacitor Cst is used to maintain the pixel voltage Vp applied to the pixel electrode.

Generally to display color images, an LCD can use a color filter method or a field sequential driving method.

A color filter method forms color filter layers composed of three primary colors of red (R), green (G), and blue (B) in one of two substrates of the LCD, and displays a desired color by controlling an amount of light transmitting from the color filter layers. Specifically, to display a desired color, the color filter method respectively controls the amount of light transmitting from each of the R, G, and B color filter layers with light from a single light source transmitted through the R, G, and B color filter layers.

An LCD device displaying color using a single light source and three (3) color filter layers needs a unit pixel corresponding to each of R, G, and B subpixels, thus at least three (3) times the number of pixels are needed compared with displaying only black and white, therefore, making the techniques of manufacturing an LCD using the color filter method more complicated.

Further complicating the matters, there are problems in that separate color filter layers need to be formed on the substrate for an LCD during manufacturing, and the light transmission rate of color filter itself needs to be improved.

In contrast with a color filter method, a field sequential driving method sequentially and periodically turns on each independent light source of R, G, and B colors, and adds color signals corresponding to each pixel that are synchronized based on the periodic lighting time of the light sources to obtain full colors. That is, in a field sequential driving type LCD, one pixel is not divided into subpixels. The R, G, and B primary color lights outputted from R, G, and B backlights of the LCD are sequentially displayed in a time-division manner so that the color images are displayed by means of an after-image effect of the eye.

The field sequential driving method can be further classified into an analog driving method and a digital driving method.

In the context of the following discussion of the present application, driving voltage refers to a voltage applied to the liquid crystal, and optical transmittivity refers to a transmittivity of light when light is transmitted through the liquid crystal. That is, optical transmittivity is a torsion degree that allows a liquid crystal to transmit light.

The analog driving method establishes a plurality of gray voltages. The method then selects one gray voltage corresponding to gray data among the gray voltages, and drives a liquid crystal panel with the selected gray voltage to perform gray display with an amount of transmission corresponding to the gray voltage applied.

FIG. 2 shows a driving voltage and an amount of light transmission of a conventional liquid crystal display using an analog driving method.

Referring to FIG. 2, a driving voltage of V11 is applied to a liquid crystal, and light corresponding to the driving voltage of V11 transmits through the liquid crystal in an R field period Tr for displaying an R color. A driving voltage of a V12 level is applied to a liquid crystal, and light corresponding to the driving voltage of V12 level transmits through the liquid crystal in a G field period Tg for displaying a G color. And a V13 level driving voltage is applied to a liquid crystal, and an amount of light transmission corresponding to the V13 level is obtained. A desired color image is, thus, displayed by a combination of R, G, and B light transmitted respectively in Tr, Tg, and Tb periods.

In contrast with an analog method, a digital driving method applies a constant driving voltage to a liquid crystal, and controls a voltage applying time to perform a gray display. The digital driving method maintains the driving voltage, and controls the voltage applying state and voltage non-applying state with respect to their timing, so as to control an accumulated amount of light transmitting to the liquid crystal.

FIG. 3 shows a waveform for explaining a driving method of a liquid crystal display of a conventional digital driving method, and shows a waveform of a driving voltage and optical transmittivity of a liquid crystal based on driving data of a predetermined bit.

Referring to FIG. 3, gray waveform data corresponding to each gray is provided with a digital signal having a predetermined number of bits, for example, a seven (7) bit digital signal, and a gray waveform according to seven (7) bit data is applied to a liquid crystal. Optical transmittivity of a liquid crystal is determined based on a gray waveform applied to perform gray display.

Regardless of whether the driving method is analog or digital, in a conventional field sequential driving method, correct gray display is not possible since an effective value response of a desired gray for display (for example, a gray of R) is changed by a previous gray display (for example, a gray of G). That is, conventionally, a pixel voltage Vp actually applied to a liquid crystal is determined by both a gray voltage (or gray waveform) supplied to the present field (for example, an R field) and a gray voltage (or gray waveform) supplied to the previous field (for example, a B field).

U.S. Pat. No. 6,567,063 discloses a field sequential driving method using a reset pulse to solve the problem of the field sequential driving method in which an effective value is changed because of a previous gray display.

FIG. 4 shows a field sequential driving method using a reset pulse described in the U.S. patent. In FIG. 4, period (T31~T36) indicates the R field, G field, and B field performing gray display for each R, G, and B. A predetermined voltage (reset voltage) is applied, which is independent of the input gray data, and is more than a maximum value of gray data applied during a predetermined time (T31~T36) at the point where each of the periods (T31~T36) are ended. A state of all liquid crystals is reset to the same state (e.g., a black state in which no light can be transmitted, that is, optical transmittivity is 0) at the point where each of the periods (T31~T36) are ended.

Thus, when liquid crystals are driven by voltages applied with gray data at each period (T31~T36), the liquid crystal state becomes the same state regardless of previous gray displays, and the display period for the present gray is not affected by the previous gray display. However, by turning off the backlights (RLED, GLED, BLED) so as to not allow light transmission during the period (reset period) when the reset voltage is applied, the period when each of R, G, and B light sources is turned on during each of the R, G, and B fields is shortened. Thus, during the reset period of the above method, there is a problem in which brightness is poor, compared with driving methods which do not use application of a reset voltage.

SUMMARY OF THE INVENTION

In the present invention, there is provided a field sequential driving type liquid crystal display for achieving both improvement of brightness and correct gray display simultaneously that overcomes the above-described shortcomings of the liquid crystal display while retaining their advantages.

To overcome the above-described shortcomings, one embodiment of the present invention provides a driving method for driving a liquid crystal display. The liquid crystal display includes a liquid crystal formed between a first substrate and a second substrate, a first electrode arranged at the first substrate, a second electrode arranged at the second substrate, and red, green, and blue lights sequentially transmitting on one pixel of the liquid crystal display. The driving method includes:

applying a gray voltage based on gray data between the first electrode and the second electrode during a first part of a first period, and applying a reset voltage to reset the liquid crystal between the first electrode and the second electrode to desired state during a second part of the first period.

In this embodiment, at least one of the red, green, and blue lights is outputted on the liquid crystal during at least some period in the first part of the first period and during at least some period in the second part of the first period.

In another embodiment of the present invention, a second driving method for driving a liquid crystal display is provided. The liquid crystal display includes a liquid crystal formed between a first substrate and a second substrate, a first electrode arranged at the first substrate, and a second electrode arranged at the second substrate. The second driving method includes applying a gray voltage based on gray data between the first electrode and the second electrode during a first part of a first period, and applying a first voltage independent of the gray data during a second part of the first period.

In this embodiment, light is outputted on the liquid crystal during at least some period in the first part of the first period and during at least some period in the second part of the first period.

In a further embodiment of the present invention, a third driving method for driving a liquid crystal display is provided. The liquid crystal display includes a liquid crystal formed between a first substrate and a second substrate, a first electrode arranged at the first substrate, a second electrode arranged at the second substrate, and red, green, and blue lights sequentially transmitting on one pixel of the display. The third driving method includes applying a gray waveform based on gray data between the first electrode and the second electrode during a first part of a first period and applying a reset pulse to reset the liquid crystal between the first electrode and the second electrode to a desired state during a second part of the first period. In this embodiment, at least one of the red, green, and blue lights is outputted on the liquid crystal during at least some period in the first part of the first period and during at least some period in the second part of the first period.

In yet another embodiment of the present invention, a fourth driving method for driving a liquid crystal display is provided. The liquid crystal display includes a plurality of scan lines, a plurality of data lines insulated and crossed with the scan lines, a plurality of pixels formed at areas surrounded by the scan lines and data lines and being arranged in a matrix format. The pixels include switches coupled to the scan lines and data lines respectively, to allow for sequential transmission of red, green, and blue lights on one pixel from among the plurality of pixels. The fourth driving method includes driving the red, blue, and green lights from a red field, a blue field, and a green field respectively. The red field, green field, and blue field each includes a first subperiod and a second subperiod. The fourth driving method further includes applying a gray voltage or gray waveform based on gray data between the first electrode and the second electrode during the first subperiod, and applying a reset voltage or reset waveform independent of the gray data during the second subperiod. In this embodiment, corresponding light of the red, green, and blue lights is outputted on the liquid crystal during at least some period in the first subperiod and during at least some period in the second subperiod.

In yet a further embodiment of the present invention, a liquid crystal display is provided. The liquid crystal display includes a liquid crystal display panel having a plurality of scan lines transferring scan signals, a plurality of data lines insulated and crossed with the scan lines, and a plurality of pixels formed at areas surrounded by the scan lines and data lines. The pixels include switches coupled to the scan lines and data lines and are arranged in a matrix format. The display further includes a gate driver for sequentially supplying scan signals to the scan lines, a gray waveform generator for generating gray waveform corresponding to gray data, a data driver for supplying the gray waveforms outputted from the gray waveform generator and for supplying reset pulses to corresponding data lines of the plurality of data lines to reset a liquid crystal state of the display to a desired state, and a light source for sequentially outputting red, green, and blue lights on at least one of the plurality of pixels.

In this embodiment, the light source is outputted on the liquid crystal display during at least some period when the data driver supplies at least one of the reset pulses to the corresponding data lines.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
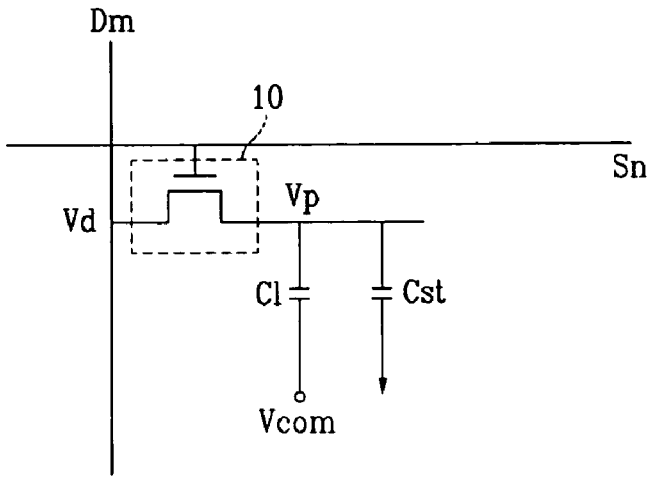
FIG. 1 shows a diagram of an equivalent circuit for a pixel of a conventional TFT-LCD.
Figure 2:
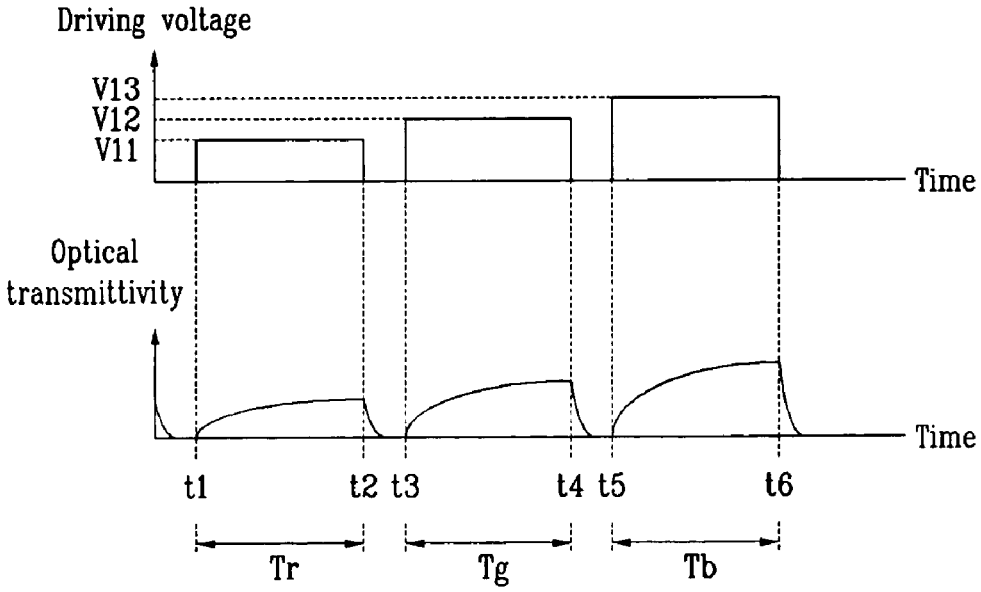
FIG. 2 shows a waveform for explaining a driving method of a liquid crystal display using a conventional analog method.
Figure 3:
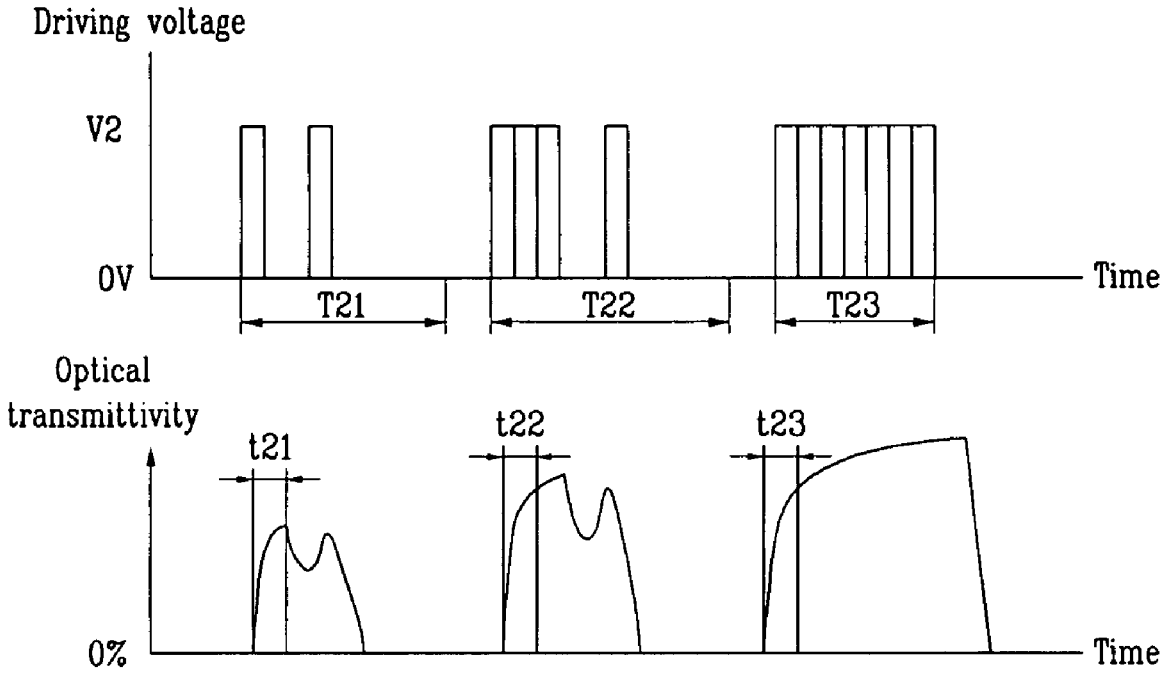
FIG. 3 shows a waveform for explaining a driving method of a liquid crystal display using a conventional digital method.

In the following detailed description, only certain exemplary embodiments of the invention are shown and described. As those skilled in the art would realize, the described embodiment may be modified in various different ways, all without departing from the spirit or scope of the present invention. Accordingly, the drawings and description are to be regarded as illustrative in nature, and not restrictive. In addition, to clarify the present invention, certain components which are not described in the specification can be omitted, and like reference numerals indicate like components.

Moreover, in the context of certain discussions of the present application, reset refers to applying a voltage (or waveform) to make liquid crystal materials in an LCD form a black state such that light transmission is blocked (e.g., optical transmittivity is almost zero (0)). Gray voltage refers to voltages having different voltage levels from each other, and gray waveform refers to waveforms having different sizes from each other with respect to an on-voltage width and an off-voltage width. Optical transmittivity refers to a ratio of light transmission to applied light when a constant light is applied to a liquid crystal, and amount of light transmitting refers to an amount of light transmission through a liquid crystal.

Figure 5:
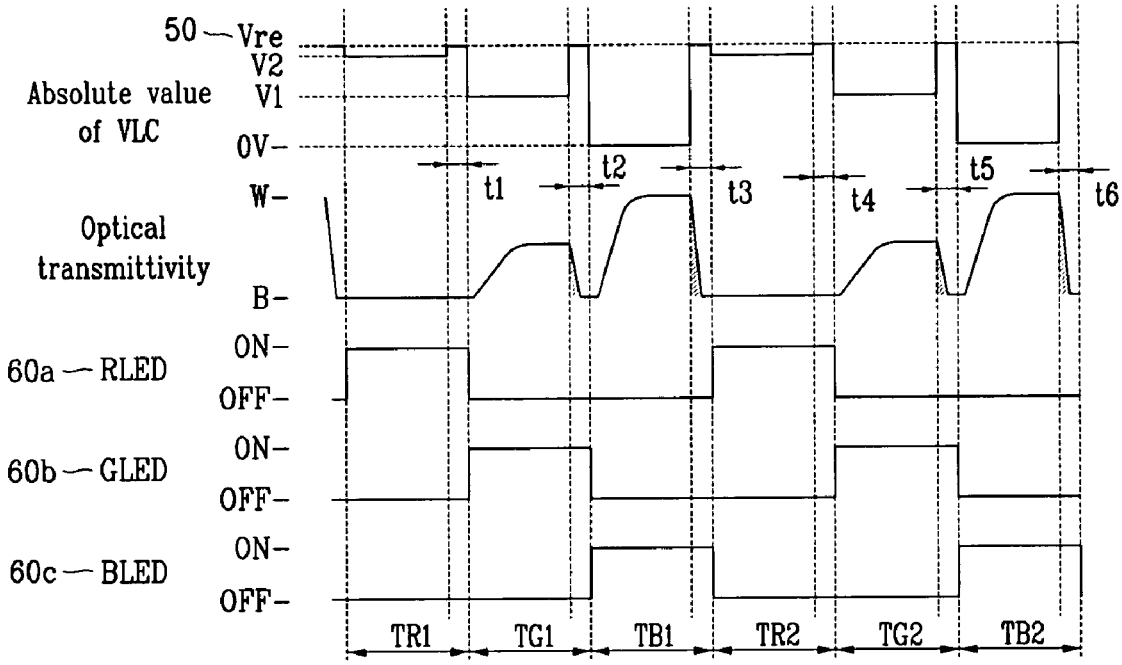
FIG. 5 shows a diagram for a driving method of a liquid crystal display according to a first exemplary embodiment of the present invention.
Figure 6:
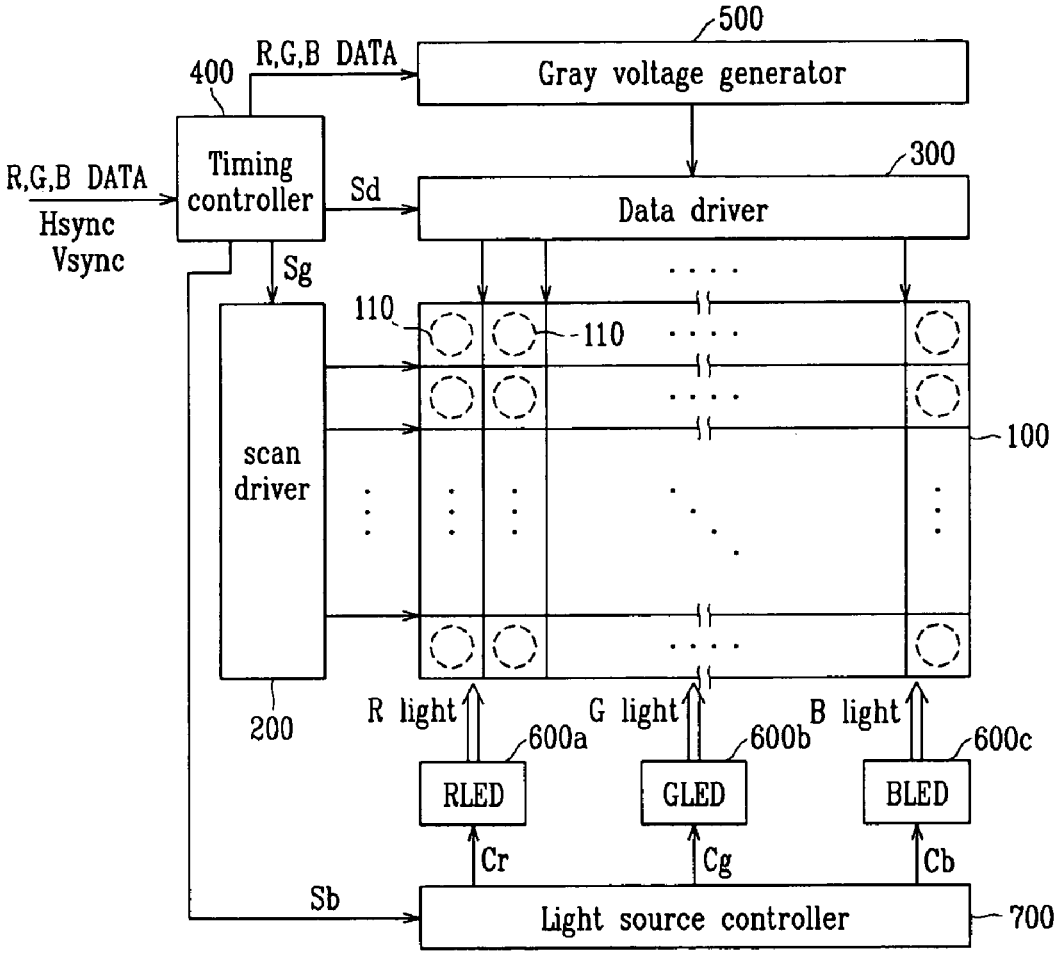
FIG. 6 shows a liquid crystal display according to the first exemplary embodiment of the present invention.

FIGS. 5 and 6 refer to a driving method according to a first embodiment of the present invention. The driving method according to the first embodiment relates to a reset driving method applied to an analog type sequential driving method.

Referring to FIG. 5, period TR1 indicates an R field for gray display of R, and period TR2 indicates another R field for another gray display of R. Period TG1 indicates a G field for gray display of G, and period TG2 indicates another G field for another gray display of G. Period TB1 indicates a B field for gray display of B, and period TB2 indicates another B field for another gray display of B.

In addition, FIG. 5 shows that a reset voltage 50 is applied to make a liquid crystal state reset to all the same state (e.g., a black state in which almost no light can be transmitted, i.e., having an optical transmittivity of about zero (0)) during a predetermined time period (T1~T6) at the point where each of the periods (T1~T6) have ended. A predetermined voltage (reset voltage) is established as the reset voltage 50, which is both independent of input gray data, and more than a maximum value of gray data. It is preferable to design an appropriate value for the reset voltage 50 which can reset states of the liquid crystal to the black state with respect to all voltages applied to the liquid crystal. Thus, in the first exemplary embodiment of the present invention, not only a reset voltage having a constant voltage that is independent of the input gray data as is shown in FIG. 5 should be established, a reset voltage having a voltage level (or width) corresponding to the input gray data should also be established.

Since the states of all liquid crystals are reset to the black state at the end point of each field by applying the reset voltage, gray display of the pixel of the next (or upcoming) field is not affected by the gray voltage applied to the pixel of the current (or previous) field when liquid crystals are driven by applying a voltage corresponding to gray data at each field period TR1~TB2.

Further, in the first exemplary embodiment, a corresponding backlight 60 is turned on even during the reset period. For example, as shown in FIG. 5, the backlight of R 60*a* is turned on even during the reset period (t1) of the R field.

Figure 4:
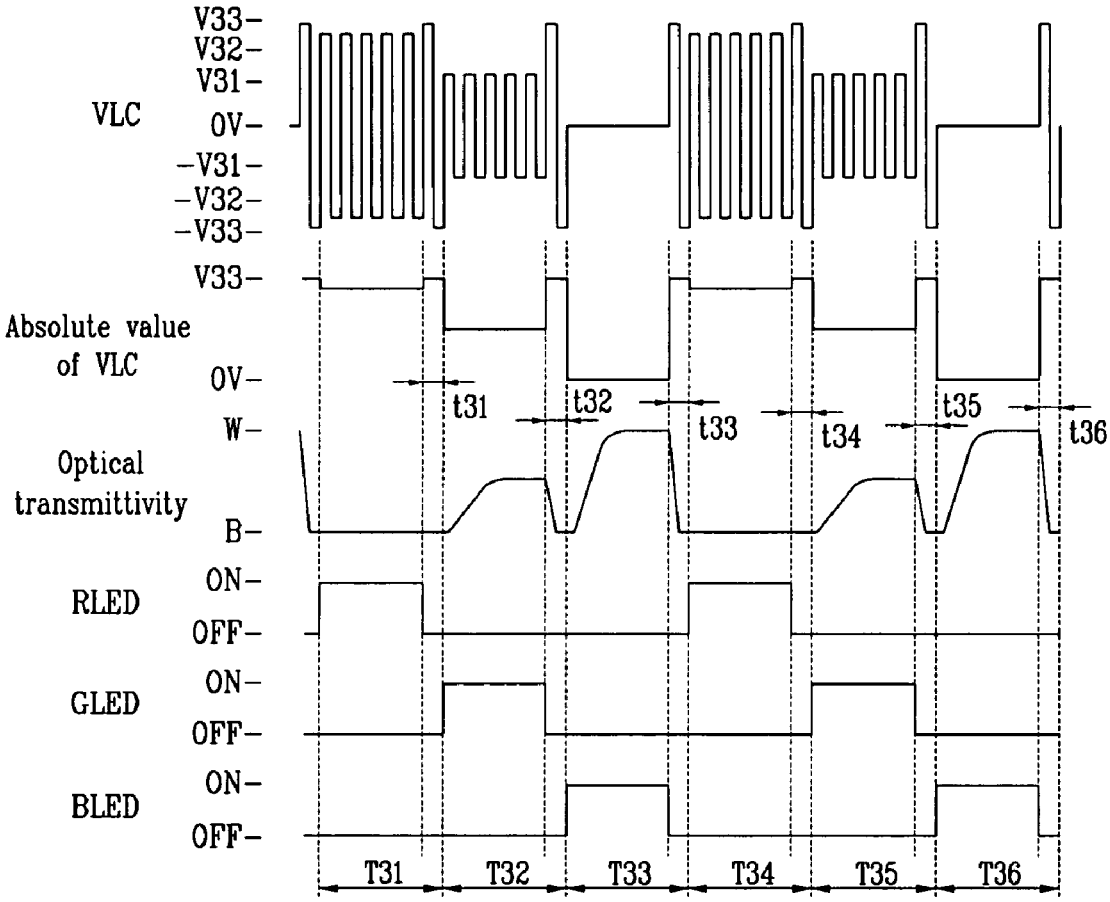
FIG. 4 shows a waveform for explaining a reset driving method of a conventional liquid crystal display device.

As such, since the backlight (e.g., the backlight of R 60*a*) is turned on to allow light transmission even during the reset period (e.g., t1) for resetting the state of each liquid crystal, light can be transmitted even during the period between the point at which the reset voltage is applied and the point at which liquid crystals turn to the black state, as shown in FIG. 5. Thus brightness can be improved compared with the conventional method shown in FIG. 4.

FIG. 6 shows a liquid crystal display for applying a reset voltage according to the first exemplary embodiment.

As shown in FIG. 6, a liquid crystal display according to the first exemplary embodiment comprises a liquid crystal display (LCD) panel 100, a scan driver 200, a data driver 300, a gray voltage generator 500, a timing controller or eraser 400, emission diodes (600*a*, 600*b*, and 600*c*) outputting R, G, and B lights respectively, and a light source controller 700.

The liquid crystal display panel 100 forms a number of scan lines for transferring gate-on signals and a number of data lines insulated and crossed with the number of scan lines for transferring a gray data and a reset voltage corresponding to the gray data. A number of pixels 110 arranged in a matrix format are respectively surrounded by the scan lines and the data lines. Each pixel 100 includes thin film transistors (not shown in FIG. 6). The scan lines and the data lines are connected to the gate electrodes and the source electrodes of the thin film transistors and pixel capacitors (not shown in FIG. 6) and storage capacitors (not shown in FIG. 6) are connected to the drain electrodes of the thin film transistors.

A gate or scan driver 200 sequentially applies scan signals to the scan lines, and allows turning on of a thin film transistor (TFT). The gate electrodes of the turned on TFT are connected to the scan lines to which the scan signals are applied.

The timing controller 400 receives gray data signals (R, G, B Data), horizontal synchronizing signals (Hsync), and vertical synchronizing signals (Vsync) from outside or from a graphic controller. The timing controller 400 then selectively supplies necessary control signals Sg, Sd, and Sb to the scan driver 200, the data driver 300, and the light source controller 700 respectively, and supplies the gray signals (R, G, B Data) to a gray voltage generator 500.

The gray voltage generator 500 generates gray voltages of sizes corresponding to the gray data which is supplied to the data driver 300. The data driver 300 applies the gray voltages outputted from the gray voltage generator 500, or reset voltages to reset corresponding data lines.

The emission diodes 600*a*, 600*b*, and 600*c* then output light corresponding to each R, G, and B to the LCD panel 100, and the light source controller 700 controls lighting time of the emission diodes 600*a*, 600*b*, and 600*c*. The exemplary embodiment uses an emission diode as a backlight, but the invention is not limited thereto.

According to the exemplary embodiment, the light source controller 700 controls lighting times of each emission diode (e.g., 600*a*, 600*b*, 600*c*) to output light even during the reset period.

Further, the time for supplying corresponding gray voltages to data lines from the data driver 300 and the time for turning on R, G, and B emission diodes by the light source controller 700 can be synchronized by the control signals provided by the timing controller 400.

Moreover, according to the first exemplary embodiment, the backlight (e.g., 600*a*, 600*b*, 600*c*) is turned on even during the reset voltage applying time, and light transmits through the liquid crystals even during the reset period. Thus, in the present embodiment, the gray voltage generator 500 is provided to set up a gray voltage corresponding to the gray data in consideration of the amount of light transmission. That is, according to the exemplary embodiment, since light is transmitted even in the reset period, the amount of light transmission can also express a certain gray. Thus, a gray generator (e.g., 500) is needed to design a gray voltage by considering the amount of light transmission caused by the reset voltage. The establishment of a gray voltage can be developed by referring to a look-up table using methods known to a person of ordinary skill in the art.

Figure 7:
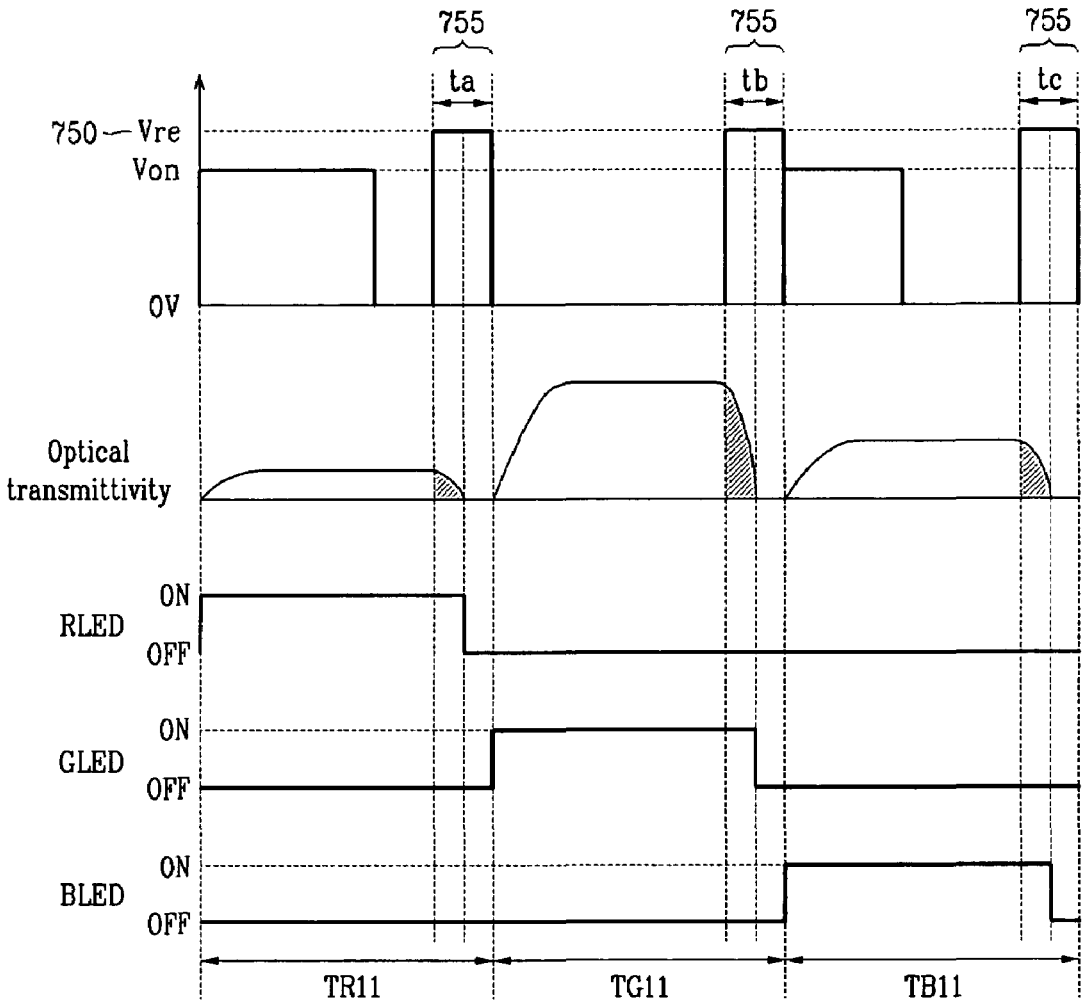
FIG. 7 shows a driving method of a liquid crystal display according to a second exemplary embodiment of the present invention.
Figure 8:
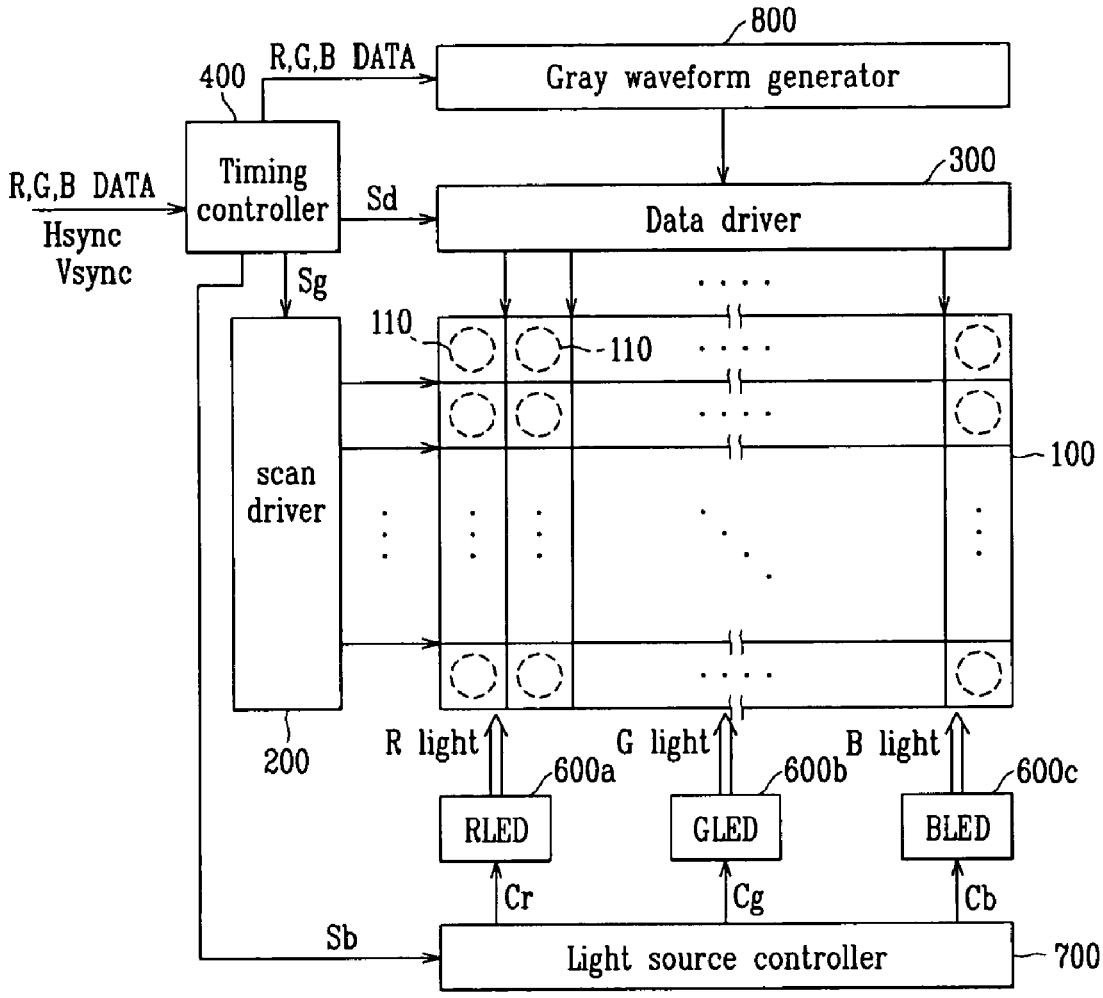
FIGS. 8 and 9 show a liquid crystal display according to the second exemplary embodiment of the present invention.

FIGS. 7 through 8 refer to a driving method according to a second exemplary embodiment of the present invention. The driving method according to the second embodiment relates to a reset driving method applied to a digital type field sequential driving method.

Referring to FIG. 7, period TR11 indicates an R field for gray display of R, period TG11 indicates a G field for gray display of G, and period TB11 indicates a B field for gray display of B.

As shown in FIG. 7, a reset pulse 750 is applied to make the state of the liquid crystal reset to a black state during a predetermined time (ta~tc) (reset period) at the point where each of the periods (TR11~TB11) ends. According to the second exemplary embodiment, a predetermined pulse is established as the reset pulse 750, which is independent of the input gray waveform. The reset pulse 750 should be designed with enough appropriate width 755 to reset the liquid crystal state to the black state with respect to all voltages applied to the liquid crystals. Thus, in the second exemplary embodiment, not only does a constant reset pulse that is independent of the input gray data need to be established as is shown in FIG. 7, a reset pulse having a pulse width corresponding to the input gray data should also be established.

Since the liquid crystal states are all black because of applying the reset pulse at the point where each of the periods ends, gray display of the pixel of the next (or upcoming) field is not affected by the gray waveform applied to the pixel of the current (or previous) field when the liquid crystals are driven by applying a voltage corresponding to the gray data at each field period TR1~TB11. And according to the second exemplary embodiment, a corresponding backlight is turned on even during the reset period (ta, tb, tc, which are periods for applying the reset bit).

According to the second embodiment, as shown in FIG. 7, since the state of the liquid crystal becomes black (i.e., the state in which optical transmittivity of the liquid crystal is zero (0)) only at some period of the reset period when the reset bit is applied, the backlight can be turned on until the state of the liquid crystal becomes black instead of turning on the backlight during the whole reset period. As such, power consumption from driving an unnecessary backlight can be minimized by only turning on the backlight during some period of the reset bit. However, the present invention is not limited thereto, and the backlight can be turned on during all the reset period.

Further, according to the second exemplary embodiment, since the backlight is turned on to allow light transmission even during the reset period for resetting the state of each of the liquid crystals, light can transmit even during the period between the point at which the reset waveform is applied and the point at which the liquid crystal turns to the black state, as shown in FIG. 7. Thus brightness can be improved compared with the conventional method shown in FIG. 4.

Figure 9:
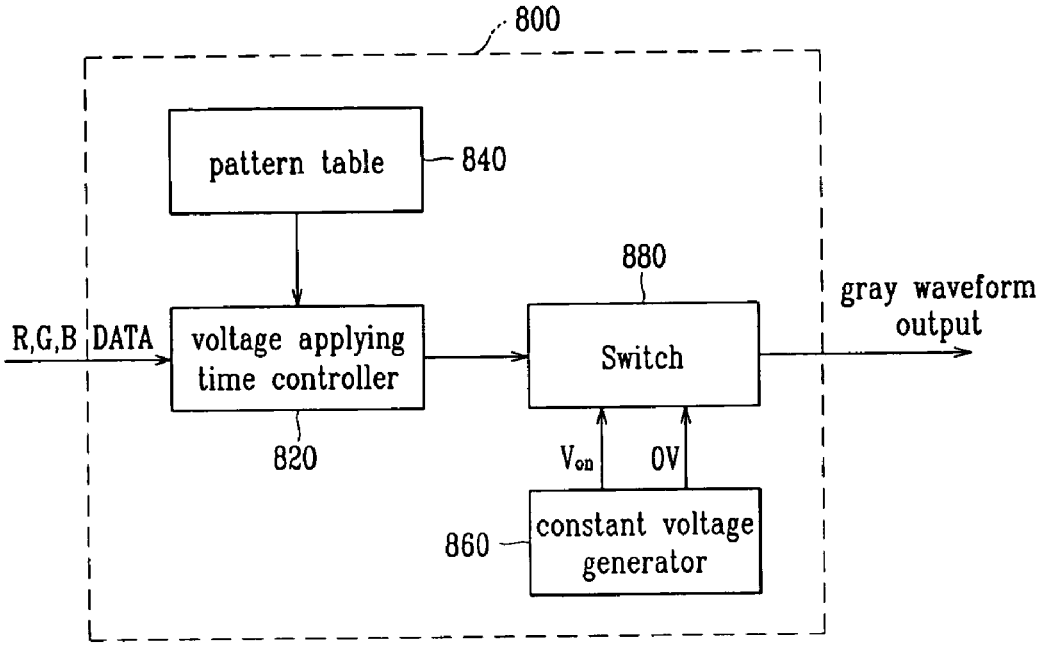

FIGS. 8 and 9 show a liquid crystal display for applying a reset waveform according to the second exemplary embodiment. In FIG. 8, the same parts of a liquid crystal display have the same reference numerals as those of the first exemplary embodiment shown in FIG. 6, and redundant explanations are not provided.

In FIG. 8, the gray waveform generator 800 generates gray waveforms with a voltage width corresponding to gray data which is supplied to the data driver 300. The data driver 300 applies gray waveforms outputted from the gray waveform generator 800, or reset waveforms, to corresponding data lines. A light source controller 700 controls lighting time of the emission diodes 600*a*, 600*b*, and 600*c*.

According to the second exemplary embodiment, since the backlight (e.g., 600*a*, 600*b*, 600*c*) is turned on even during the reset pulse applying time, and light transmits through liquid crystals even during the reset period, it is, thus, necessary that a gray waveform generator (e.g., 800) sets up a gray waveform corresponding to gray data, the gray waveform generator sets up the gray waveform by considering the amount of light transmission, which can be developed by referring to a look-up table using methods known to those skilled in the art.

FIG. 9 shows a detail view of a gray waveform generator 800 according to the second exemplary embodiment.

As shown in FIG. 9, the gray waveform generator 800 according to this exemplary embodiment includes a voltage applying time controller 820, a pattern table 840, a constant voltage generator 860, and a switch 880.

The pattern table 840 stores gray waveform patterns (on/off patterns) corresponding to gray data. According to the exemplary embodiment of the present invention, the pattern table stores four (4) bit on/off patterns corresponding to six (6) bit gray data. For example, according to the exemplary embodiment, the pattern table stores a 1011 on/off pattern (here, "1" is on waveform, and "0" is off waveform) corresponding to six (6) bit gray data of 101111.

The voltage applying time controller 820 extracts gray waveform patterns (on/off patterns) corresponding to input gray data (R, G, and B Data) from the pattern table 840, and controls on/off operation and on/off time of the switch 880 based on extracted gray waveform patterns. Specifically, the voltage applying time controller 820 controls the switch 880 to allow the first voltage (Von) to be applied so as to turn on a liquid crystal during the predetermined time, when the extracted gray waveform patterns (on/off) pattern value is "1". And the voltage applying time controller 820 controls the switch 880 to allow the second voltage (0 V) to be applied so as to turn off a liquid crystal, when the extracted gray waveform patterns (on/off) pattern value is "0". The constant voltage generator 860 generates the first voltage (Von) and the second voltage (0 V) which are supplied to the switch 880.

The switch 880 selects the first voltage or the second voltage that are both outputted from the constant voltage generator 860 based on control operation of the voltage applying time controller 820. The switch 880 then outputs corresponding gray waveforms to the data driver 300.

Figure 10:
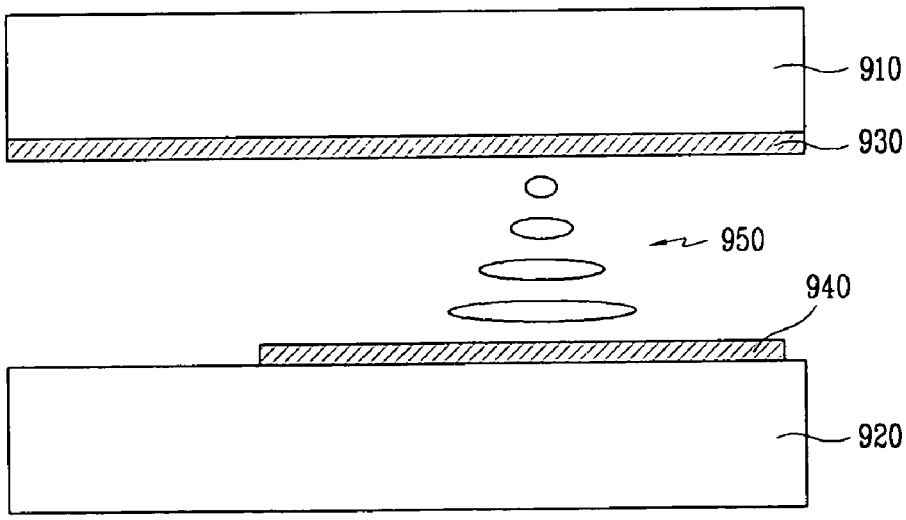
FIG. 10 shows a diagram for a pixel of a TFT-LCD.

FIG. 10 shows a pixel of a TFT-LCD. The pixel includes a liquid crystal 950 formed between a first substrate 910 and a second substrate 920, a first electrode (common electrode) 930 arranged at the first substrate 910, and a second electrode (pixel electrode) 940 arranged at the second substrate 920. Exemplary embodiments of the present invention can be applied to the pixel of FIG. 10, as well as other suitable pixels. In addition, the first and second substrates 910, 920 and the liquid crystal 950 may be equivalently represented, for example, as the liquid crystal capacitor Cl in FIG. 1.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof. For example, the exemplary embodiments of the present invention disclose applying gray voltages or waveforms to liquid crystals and turning on the backlight almost simultaneously, however, in addition a backlight can be turned on when gray voltages or waveforms are applied and optical transmittivity of liquid crystals reaches a relatively constant state.

What is claimed is:

1. A liquid crystal display comprising:

a liquid crystal display panel comprising a plurality of scan lines for transferring scan signals, a plurality of data lines insulated and crossed with the scan lines, and a plurality of pixels at areas surrounded by the scan lines and data lines, the pixels including switches coupled to the scan lines and data lines and being arranged in a matrix format;

a gate driver for sequentially supplying scan signals to the scan lines;

a gray waveform generator for generating gray waveforms corresponding to gray data;

a data driver for supplying the gray waveforms outputted from the gray waveform generator and for supplying reset pulses to corresponding data lines of the plurality of data lines, the reset pulses for resetting at least one liquid crystal state to a desired state; and a light source for sequentially outputting red, green, and blue light on at least one of the plurality of pixels, wherein the light source is outputted on the liquid crystal display during at least some part of each period when the data driver supplies at least one of the reset pulses to the corresponding data lines, and wherein the gray waveform generator comprises:

a pattern table for storing gray waveform patterns corresponding to the gray data;

a constant voltage generator for generating a first voltage and a second voltage;

at least one of the switches coupled to the scan lines and data lines for selecting a voltage between the first voltage and the second voltage; and a voltage applying time controller for extracting at least one of the gray waveform patterns corresponding to input gray data from the pattern table, and controlling operation of the at least one of the switches based on the extracted gray waveform pattern.

2. The liquid crystal display of claim 1, wherein the at least one of the reset pulses is independent of the gray data.

3. The liquid crystal display of claim 1, wherein the desired state of liquid crystal is a state in which optical transmittivity is about zero (0).

4. The method of claim 1, wherein the reset pulse has a substantially constant pulse width.

* * * * *